United States Patent [19]

Rhee

[11] 4,379,391

[45] Apr. 12, 1983

[54] REFRIGERATOR

[76] Inventor: Jae W. Rhee, 369-7 Sukyo-Dong, Mapo-ku, Seoul, Rep. of Korea

[21] Appl. No.: 270,353

[22] Filed: Jun. 4, 1981

[30] Foreign Application Priority Data

Jun. 5, 1980 [KR] Rep. of Korea ..... 3614/80

[51] Int. Cl.[3] ..... F25D 17/04

[52] U.S. Cl. ..... 62/408; 62/255; 62/256

[58] Field of Search ..... 62/255, 256, 408, 418

[56] References Cited

U.S. PATENT DOCUMENTS

| | | | |
|---|---|---|---|
| 2,516,432 | 7/1950 | Spencer | 62/256 |
| 2,558,997 | 7/1951 | Voelker | 62/255 X |
| 3,182,466 | 5/1965 | Beckwith | 62/255 X |
| 4,299,092 | 11/1981 | Ibrahim | 62/256 X |

*Primary Examiner*—Lloyd L. King

*Attorney, Agent, or Firm*—Cushman, Darby & Cushman

[57] ABSTRACT

A refrigerator wherein, in order to prevent cold air within the refrigerator body from flowing out while the door is opened, and air curtain will be formed in the opening of the body when the door is opened but will be removed when the door is closed.

4 Claims, 4 Drawing Figures

REFRIGERATOR

BACKGROUND OF THE INVENTION (a) Field of the Invention

This invention relates to improvements in refrigerators and more particularly to a refrigerator wherein, while the door is opened, cold air can be prevented from flowing out.

(b) Description of the Prior Art

Generally, a refrigerator is of such structure that, when the door is opened, inside cold air will flow out and outside warm air will be able to advance into the refrigerating chamber. Therefore, particularly in summer, if the door is often opened and closed, the outflow of cold air and inflow of warm air will increase and a large electric power will be required in order to maintain the temperature of the refrigerating chamber at a predetermined value. When cold air flows out of the refrigerating chamber, outside warm air advances into the refrigerating chamber and the temperature within the refrigerating chamber once rises, it will take some time for the temperature to fall down to a predetermined temperature and meanwhile the refrigerated articles will be decomposed and the role as of a refrigerator will be likely to be reduced.

SUMMARY OF THE INVENTION

A primary object of the present invention is to provide a refrigerator wherein, even while the door is opened, no cold air will flow out of the refrigerating chamber.

According to the present invention, this object is attained by forming an air curtain in the opening of the refrigerating chamber only while the door is opened. Thereby there can be provided a refrigerator wherein, even if the door is often opened and closed, the temperature within the refrigerating chamber will be kept substantially constant and therefore the electric power consumption will be very low.

According to a preferred formation of the present invention, when the door is opened, in order to form an air curtain in the opening of the refrigerating chamber, air will be jetted out toward the upper part from the lower part of the opening. This will serve to effectively prevent cold air from flowing out of the refrigerating chamber.

According to another formation of the present invention, when the door is opened, in order to form an air curtain in the opening of the refrigerating chamber, a jetted air stream in the horizontal direction will be produced in the opening.

According to another further formation of the present invention, when the door is opened, in order to form an air curtain in the opening of the refrigerating chamber, jetted air streams in the vertical direction and horizontal direction will be produced in the opening. They will serve to thicken the air curtain.

DESCRIPTION OF THE PREFERRED EMBODIMENTS

Figure 1:
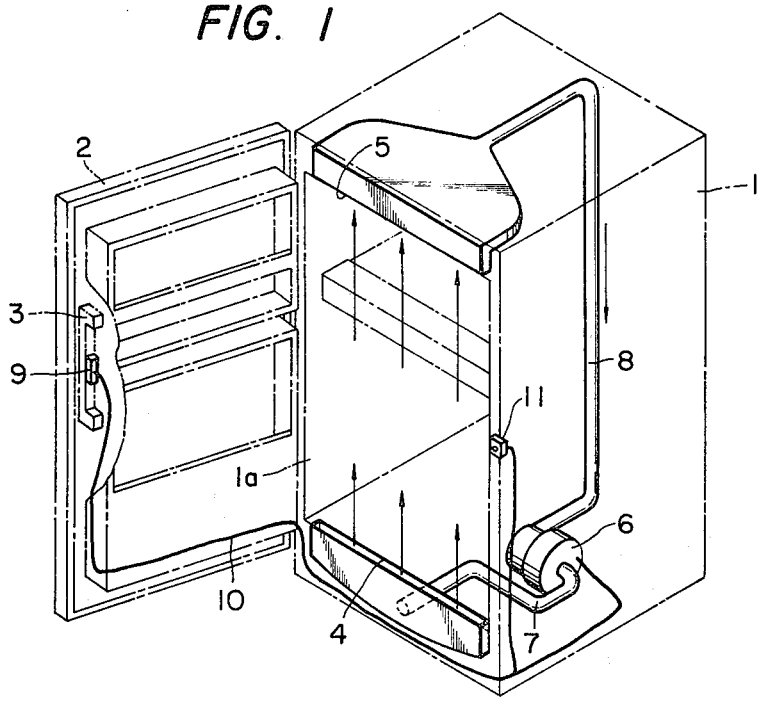
FIG. 1 is a perspective view of an embodiment of the refrigerator according to the present invention wherein the door is opened.
Figure 2:
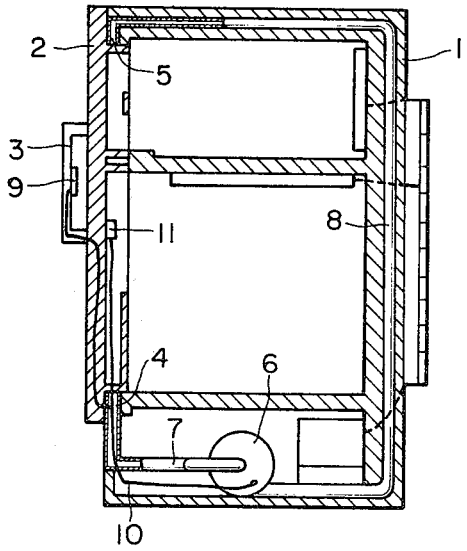
FIG. 2 is a vertical sectional view of the refrigerator shown in FIG. 1 wherein the door is closed.

First, in FIGS. 1 and 2, reference numeral 1 denotes a box-shaped refrigerator body including a refrigerating chamber, 2 denotes a door fitted to an inlet 1*a* of the refrigerator body 1 so as to be able to be opened and closed and 3 denotes a handle secured to the surface of the door 2. Reference numeral 4 denotes an elongate air jetting port provided along the lower edge of the inlet 1*a* of the refrigerator body 1, 5 denotes an elongate air sucking port provided along the upper edge of the refrigerator inlet 1*a* so as to be opposed to the air jetting port 4, 6 denotes a blower arranged in the lower part of the refrigerator body 1 and connected on the blowing side to the air jetting port 4 through a blowing pipe 7 and on the sucking side to the air sucking port 5 through a sucking pipe 8, 9 denotes a blower driving normally opened first switch fitted to the handle 3, formed to be ON when the user grips the handle 3 and to be OFF when the user releases the handle and connected to the blower 6 through a lead wire 10 and 11 denotes a second switch fitted to the right edge part of the refrigerator inlet 1*a*, formed to be ON when the user opens the door 2 and to be OFF when the door is closed and connected in parallel with the first switch 9. By the way, the first switch 9 and second switch 11 may be either of an electronic type or of a mechanical type.

As the refrigerator of the present invention is formed as described above, when the user first grips the handle 3 to open the door, the first switch 9 will be ON, the blower 6 will start and will begin to feed air to the jetting port 4 and to suck air from the sucking port 5. When the door 2 is then opened, as shown in FIG. 1, air will be immediately jetted as a band-shaped stream out of the jetting port 4 and will be sucked through the sucking port 5, therefore an air curtain will be formed in the refrigerator inlet 1*a* and the circulation of air between inside and outside the refrigerator will be thereby interrupted. Further, when the door 2 is opened, the second switch 11 will be also ON. Therefore, even if the user then releases the handle 3 and the first switch 9 becomes OFF, the blower 6 will continue to operate and the above mentioned air curtain will continue to be formed. Therefore, even when the door is opened, inside cold air will be prevented from flowing out of the refrigerator and outside warm air will be prevented from flowing into the refrigerator. When the user then closes the door 2 by gripping the handle 3, the second switch 11 will be OFF but the first switch 9 will be again ON, therefore the blower 6 will continue to operate and the above mentioned air curtain will still remain held. Finally, when the user releases the handle 3, the first switch 9 will be also OFF, the blower 6 will stop and the above mentioned air curtain will be removed. Thus, in the refrigerator of the present invention, even if the door 2 is often opened and closed, the air curtain will effectively prevent inside cold air from flowing out of the refrigerator and outside warm air from flowing into the refrigerator, therefore the temperature within the refrigerator will not rise, thus the refrigerating effect will not be lost even temporarily and the refrigerated articles will be prevented from being decomposed. For the same reasons, the electric power required to maintain the temperature within the refrigerator at a set temperature may be so small as to be economical.

Figure 3:
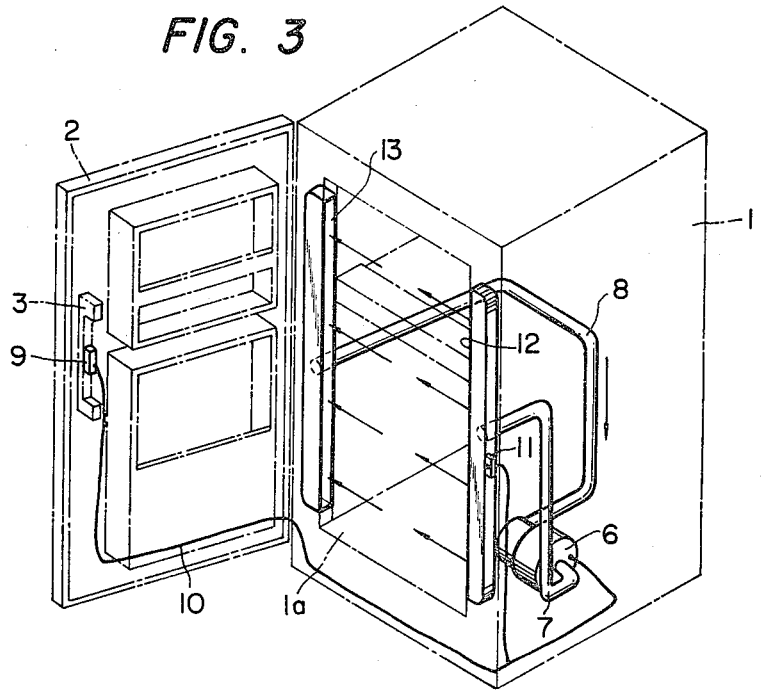
FIG. 3 is a perspective view showing another embodiment of the refrigerator according to the present invention.
Figure 4:
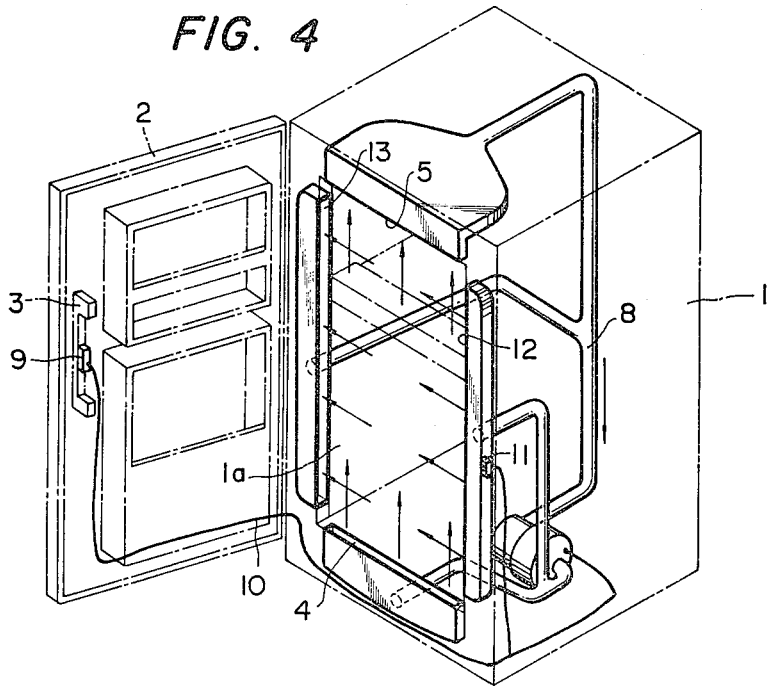
FIG. 4 is a perspective view showing still another embodiment of the refrigerator according to the present invention.

By the way, in the above mentioned embodiment, the air jetting port 4 and air sucking port 5 are provided as opposed to each other respectively in the lower edge part and upper edge part of the refrigerator inlet 1*a*. As different from them, as in the second embodiment shown in FIG. 3, an air jetting port 12 and air sucking port 13 may be provided as opposed to each other respectively in the right edge part and left edge part of the refrigerator inlet 1*a*. Further, as in the third embodiment shown in FIG. 4, the air jetting port 4 and air sucking port 5 may be provided as opposed to each other respectively in the lower edge part and upper edge part of the refrigerator inlet 1*a* and the air jetting port 12 and air sucking port 13 may be provided as opposed to each other respectively in the right edge part and left edge part of the refrigerator inlet 1*a*. In such case, the respective air jetting ports and air sucking ports are so arranged that the air curtain formed by the air jetting port 4 and air sucking port 5 and the air curtain formed by the air jetting port 12 and air sucking port 13 may be in different vertical planes.

I claim:

1. A refrigerator comprising a refrigerator body, a door fitted to said refrigerator body so as to be able to be opened and closed, at least one set of an air jetting port and air sucking port provided opposed to each other in the opening of the refrigerator body to form an air curtain in said opening when said door is opened, a blower arranged within said body and connected on the blowing side to said air jetting port and on the second side to said air sucking port, a normally open first switch means fitted to the handle of said door and closed to start said blower when said handle is gripped by a hand to open said door, and a second switch means fitted to said body and connected in parallel with said first switch and closed to drive said blower when said door is opened.

2. A refrigerator according to claim 1 wherein said air curtain is formed of an air stream flowing in the vertical direction in said opening.

3. A refrigerator according to claim 1 wherein said air curtain is formed of an air stream flowing in the horizontal direction in said opening.

4. A refrigerator according to claim 1 wherein said air curtain is double formed of an air stream flowing in the vertical direction in said opening and an air stream flowing in the horizontal direction in said opening.

* * * * *